US009820590B2

(12) United States Patent
Karasiewski et al.

(10) Patent No.: US 9,820,590 B2
(45) Date of Patent: Nov. 21, 2017

(54) SLIDE N' STRETCH STRETCHER BAR WITH CONNECTING SEGMENTS

(71) Applicants: Richard David Karasiewski, Elkridge, MD (US); Claudia Marie Cappelle, Woodbridge, VA (US)

(72) Inventors: Richard David Karasiewski, Elkridge, MD (US); Claudia Marie Cappelle, Woodbridge, VA (US)

( * ) Notice: Subject to any disclaimer, the term of this patent is extended or adjusted under 35 U.S.C. 154(b) by 61 days.

(21) Appl. No.: 15/076,008

(22) Filed: Mar. 21, 2016

(65) Prior Publication Data

US 2017/0265660 A1 Sep. 21, 2017

(51) Int. Cl.

| | |
|---|---|
| ***A47G 1/08*** | (2006.01) |
| ***A47G 1/06*** | (2006.01) |
| ***B44D 3/18*** | (2006.01) |
| ***A47G 1/10*** | (2006.01) |

(52) U.S. Cl.

CPC ..... *A47G 1/08* (2013.01); *A47G 1/06* (2013.01); *A47G 1/065* (2013.01); *A47G 1/10* (2013.01); *B44D 3/18* (2013.01); *B44D 3/185* (2013.01)

(58) Field of Classification Search

CPC ..... D06F 59/00; D06F 59/08; A47G 1/08; A47G 1/065; A47G 1/10; A47G 1/06; B44D 3/185; B44D 3/18; D05C 1/02; D06C 3/00; D06C 3/08

See application file for complete search history.

(56) References Cited

U.S. PATENT DOCUMENTS

| | | | | | |
|---|---|---|---|---|---|
| 1,286,340 | A * | 12/1918 | Keim | D06F 59/08 | 38/102.9 |
| 1,443,923 | A * | 1/1923 | Henri | B44D 3/185 | 38/102.8 |
| 1,916,023 | A * | 6/1933 | Shull | B44D 3/185 | 160/374.1 |
| 3,465,461 | A * | 9/1969 | Price | A47G 1/08 | 40/209 |
| 4,179,830 | A * | 12/1979 | Lamb | B44D 3/185 | 160/378 |
| 5,515,630 | A * | 5/1996 | Maher | A47G 1/08 | 40/739 |

(Continued)

FOREIGN PATENT DOCUMENTS

FR 2938412 A1 * 5/2010

*Primary Examiner* — Ismael Izaguirre

(57) ABSTRACT

Disclosed is a fine art stretcher bar framing and canvas fastening system. The system consists of variable length side bars, fixed ninety degree corners, internal connecting segments, and an adjustable cross brace for quick and easy assembling, dismantling, storing, and transporting. The side bars, corners, and connecting segments features a mechanism utilizing a male plug and female socket to connect side bars, corners, and connecting segments in an array of stretcher bar configurations. The segments are secured using interlocking pins after side bars or corners female sockets engaged with connecting segment plugs. The cross brace segments features an adjustable mechanism conforming to the stretcher bar configuration. The side bars, corners, connecting, and cross brace segments can be dismantled by removing interlocking mechanism on the segments. The back side of the stretcher bar system features a wooden surface to mount or dismount canvases using staples or other fasteners.

8 Claims, 15 Drawing Sheets

(56) References Cited

U.S. PATENT DOCUMENTS

| | | | | | |
|---|---|---|---|---|---|
| 5,575,113 | A * | 11/1996 | Huang | E06B 9/02 | 160/372 |
| 6,253,471 | B1 * | 7/2001 | Strauh | B44D 3/185 | 160/381 |
| 7,007,735 | B1 * | 3/2006 | Lake | E06B 9/52 | 160/374.1 |
| 8,453,362 | B2 * | 6/2013 | Cappelle | B44D 3/185 | 38/102.5 |

* cited by examiner

SLIDE N' STRETCH STRETCHER BAR WITH CONNECTING SEGMENTS

BACKGROUND OF THE INVENTION

1. Field of the Invention

The present invention relates to the field of stretcher bar frames (stretcher bars) and canvas fastening. More particularly, this invention is a unique and improved stretcher bar system using slide fitting, interchangeable, variable length side bar segments, fixed ninety degree corner segments, internal connecting segments, and adjustable cross brace segments, allowing for lengthening or shortening of the sides of the stretcher bars and cross brace extensions. It features internal connecting segments with an interlocking pins mechanism, and connecting cross brace segments with an interlocking nut and bolt mechanism, for easy assembling/disassembling of the stretcher bars and cross brace segments. The stretcher bars and canvas fastening system also provides for easy mounting, re-stretching, dismantling, transporting and remounting of fine art canvases to an array of configurable stretcher bar frame sizes.

2. The Prior Art

In the field of fine art, canvas paintings are traditionally mounted to a permanent, non-adjustable, wooden frame comprised of wooden sections referred to as stretcher bars that provide a taunt support for artist stretched canvases. The stretcher bar wooden sections are assembled by means of interlocking dove-tail edges wedged together to form non-exact, ninety degree corners. Wooden tightening wedges are used to adjust corners to produce a perfect square. Cross braces are sometimes used as a stabilizing tension brace. Canvas or other material is stretched around and over the front perimeter of the stretcher bars and affixed to the back side by conventional means using staples or nails.

In general, current commercially known wooden stretcher bars are made and sold in fixed size bars or pre-assembled frame sizes and cannot to be customized in length and width. Several other limitations of wooden stretcher bars include difficulty in forming exact ninety degree corners, affordability, and transporting of large depth stretcher bars. A limited number of adjustable frames that expand or contract in some manner are known. These adjustable frames have various limitations and are difficult to use. U.S. Pat. No. 4,519,151 discloses a hollow tubular metallic frame coupled together at the end by a co-acting pair of corner elements. The frame size can be selectively expanded and contracted by inserting one of five fixed lengths of tubular frame side elements. Major disadvantages of this design is its limited non-combinable fixed length dimensional sides and round tubular sides that are not generally used in the field of fine art or acceptable by galleries. U.S. Pat. No. 4,144,660 discloses an adjustable canvas stretching frame of separate, interchangeable, uniform frame segments, which can be interconnected to form a limited number of small rectangular or square frames. The primary feature of this device is to provide a means to maintain an overall rectangular shape of the frame, adjust gaps between adjacent segments of the frame, and to provide a taut surface by adjusting the tension within individual frame segments, so a canvas can be re-stretched without damaging the canvas and/or removing the canvas from the frame. Several shortcomings to this mechanically complex design include its numerous parts and special hardware required for its assembly. Additionally, it does not allow for a canvas to be easily removed and reused. U.S. Pat. No. 6,253,471 discloses an adjustable canvas stretching frame with fixed corners and non-connectable, fixed wooded sides, which require cutting to a desired length and width. Several labor intensive shortcomings to this design include advance knowledge of woodworking technique, tools to cut wood to exact length and width for the sides, a drill to cut circular apertures, a router for notches, and metal screws to secure the frame. When a different side length or width is desired, additional wood and woodworking skills are required. U.S. Pat. No. 6,895,701 discloses an adjustable metal strainer frame for mounting art canvas eliminating conventional welding and hardware item such as rivets, nuts, and bolts. Major shortcomings to this design include having to cut metal sides to fixed lengths when a different side length or width is desired, the inability to connect side members to form longer or shorter side lengths, and the need to use bracing and hardware to form a secure ninety degree corners. U.S. Pat. No. 6,675,510 discloses a lateral and longitudinal mechanized edge gripping method to avoid uneven stresses, distortion, corner wrinkles, and tearing of canvas. It primarily allows for removal and remounting of the canvas but the disadvantage is that its difficulty to evenly stretch canvas due to interference from and canvas grippers. Additional and various other prior art is also cited in U.S. Pat. Nos. 3,482,343, 4,144,660, 4,179,830, and 4,519,151, and is incorporated herein by reference.

The above framing and stretching canvas references are primarily for attaching or remounting of canvas and do not allow for modifications in the overall size of the stretcher bar frame. The prior art is not designed to easily adjust for any lengthening, shortening, or correcting a canvas due to changes in environmental conditions, nor do they provide the capability or means, without prior training, skill, experience, or strength, to quickly and easily assemble/disassemble, or lengthening/shortening the stretcher bar frame to other frame configurations. The prior art does not allow the cross brace to be adjusted to match modification in the stretcher bar frame. The prior art does not allow the stretcher bars to be easily dismantled for compact storage and for less costly transport. It also does not address the need for affordable large stretcher bars.

SUMMARY OF THE INVENTION

The primary object of the present invention is to provide an affordable, easily reconfigurable, stretcher bar frame, adjustable cross brace, and canvas fastening system that quickly and easily slides and fastens together using a combination of interconnecting and interchangeable, variable length side bar segments, corner segments, internal connecting segments, adjustable cross brace segments, interlocking pins, and interlocking nuts and bolts.

It is a further object of this invention to provide a stretcher bar framing system where the side lengths and widths of the stretch bar frame can be lengthened or shortened by adding or subtracting an even number of side bar segments to the stretcher bar frame to form an array of configurable and customized stretcher bar frame sizes using a combination of incremental length side bar segments.

It is a further object of this invention to provide a stretcher bar framing system where the adjustable cross brace can be lengthened or shortened to match up and join with an array of configurable stretcher bar frame sizes.

It is a further object of this invention to provide a novel and unique single stretcher bar frame system having a multiplicity of configurable stretcher bar frame sizes, eliminating the expense of having to have or maintain a large array of various fix length costly stretcher bar frames.

It is a further object of this invention to provide a fixed ninety degree corner segment with a fixed angular corner brace allowing for exact ninety degree corners without the need for wedges, additional corner bracing, or corner tension bars.

It is a further object of this invention to provide a system where an interlocking pin mechanism is formed within each side bar segment, longitudinal end side surface, female socket member cavity or within each corner segment, perpendicular longitudinal end side surface, female socket member cavity, when an internal connecting segment male plug member is fully inserted into either a side bar segment or corner segment female socket member cavity.

It is a further object of this invention to provide a system where side bars and corner segments pin entry apertures engage, match up, and join internal connecting segment pin entry apertures, and interlock using interlocking pins creating strong, rigid, tight and straight stretcher bar frame.

It is a further object of this invention to provide a stretcher bar framing system that can be quickly and easily assembled, dismantled, reconfigured, transported, or stored by removing interlocking pins from the side bar segments, corner segments, and internal connecting segments inside surface pin entry apertures.

It is a further object of this invention to provide a stretcher bar framing system, adjustable cross brace, that can be quickly and easily assembled, dismantled, reconfigured, transported, or stored by removing interlocking nuts and bolts from the cross brace center segments and cross brace extensions segments.

It is another object of this invention is to provide an means to fasten a canvas to the back surface of the stretcher bar frame, allowing staples, tacks, or other gripping fasteners to secure a canvas to the frame, and allowing a canvas to be removed, re-mounted stretched, re-stretched, repeatedly on the same size or reconfigurable size stretcher bar frame.

It is still a further object of this invention to provide a system with side bar segments, corner segments, internal connecting segments, and adjustable cross brace segments are preferably made wood or a low cost, light-weight, non-warping, durable plastic, resin, or any suitable material known in the art for molding or machining that provides structural durability, resiliency, and stability.

Finally, it is a goal of this invention to provide a stretcher bar frame, adjustable cross brace, and canvas fastening system encompassing an array of various dimensional or profile depth.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENT OF THE INVENTION

Figure 1:
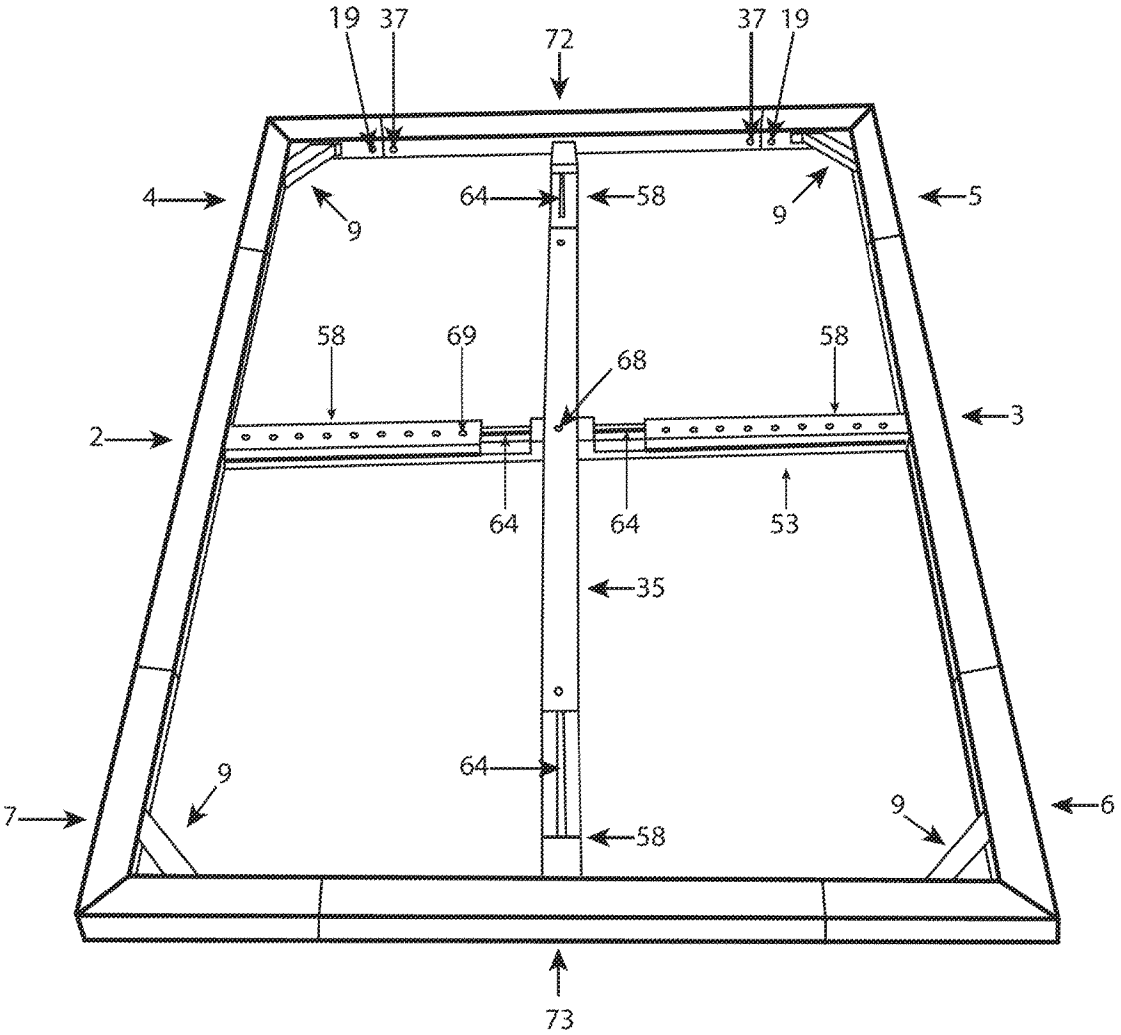
FIG. 1 is a three-dimensional perspective back view front of the first embodiment of the stretcher bar frame, adjustable cross brace, and canvas fastening system assembled in accordance with the present invention; illustrating side bar segments, cross brace segments, and corner segments with fixed angular cross braces.

The present invention relates to a novel and unique stretcher bar frame, adjustable cross brace, and canvas fastening system that comprises of a plurality of slide fitting, interchangeable, interconnecting, variable length side bar segments, fixed 90 degree corner segments, internal connecting segments, interlocking pins, cross brace center segments, cross brace extension segments, and interlocking barrel nuts and bolts. With reference to the drawings, and initially to FIG. 1, it can be seen how the stretcher bar frame and canvas fastening system allows for the assembly of a broad array of square and rectangular shaped stretcher bar frames 1. This is accomplished by adding or removing various length side bar segments 2, 3, 72, and 73, along the periphery within the four corner segments 4, 5, 6, and 7, to lengthen or shorten the length and width of the sides of the stretcher bar frame 1. It can also be seen how the adjustable cross allows for support of the side bar segments from inward bowing. This is accomplished by placing four sliding cross brace extension segments 58, along two cross brace center segments 35 and 53, on the inside of the stretcher bar frame 1. As noted above, FIG. 1 is a view that depicts an assembled stretcher bar frame 1, in one of many achievable configurations. It consist of four side bar segments 2, 3, 72, and 73, four corner segments 4, 5, 6, and 7, eight connecting segments 8, two cross brace center segments 35 and 53, and four cross brace extension segments 58.

The depicted stretcher bar frame FIG. 1, is configured by placing corner segments 4, 5, 6, and 7, in each of the four opposing corners with the corner segment inside surfaces 36 facing equal distance towards the center, placing side bar 2 between corner segments 4 and 7, placing side bar 72 between corner segments 4 and 5, placing side bar 3 between corner segments 5 and 6, placing side bar 73 between corner segments 6 and 7. It is further arranged by placing a connecting segment 8 between side bar 2 and corner segment 4, placing a connecting segment 8 between corner segment 4 side and side bar 72, placing a connecting segment 8 between side bar 72 and corner segment 5, placing a connecting segment 8 between corner segment 5 and side bar 3, placing a connecting segment 8 between side bar 3 and corner segment 6, placing a connecting segment 8 between corner segment 6 and side bar 73, placing a connecting segment 8 between side bar 73 and corner segment 7, placing a connecting segment 8 between corner segment 7 and side bar 2.

The depicted stretcher bar frame, adjustable cross brace in FIG. 1, is configured by matching and placing the midpoint of cross brace center segment one 35, front side surface 49, at the midpoint of cross brace center segment two 53, front side surface 54, between the two stationary center blocks 71, and securing the cross brace center segments 35 and 53, at their center nut and bolt aperture 68, with a barrel nut and bolt 67. The four cross brace extension segments 58, attaches to the cross brace center segments 35 and 53, by sliding a cross brace extension segment 58, dovetail socket 65, onto cross brace center segment 35, dovetail 64, at each cross brace segment outer end surface 52, and by sliding a cross brace extension segment 58, dovetail socket 65, onto cross brace center segment 53, dovetail 64, at each cross brace segment outer end surface 57.

The length of each cross brace extension segment 58, is adjusted to the stretcher bar size in FIG. 1, by inserting the cross brace extension segment 58, cross brace insert 70, into the side bar inside surface cross brace entry channel 20, and by matching the cross brace adjustable apertures 69, on each cross brace extension segment 58 with cross brace center segments 35 and 53, and securing the six cross brace segments with four barrel nut and bolt 67.

The depicted stretcher bar frame FIG. 1, is assembly and interlocked by inserting the first connecting segment 8, end side surface 29 (also referred as a male plug member 11), into side bar 2, end side surface 21, side cavity 22 (also referred as a female socket member 12), inserting a interlocking pin 46, into and through the side bar inside surface pin entry aperture 19, into the connecting segment pin entry aperture 31; inserting the opposing side of the first connecting segment 8, end side surface 29, into corner segment 4, end side surface 40, side cavity 22, (also referred as a female socket member 12), inserting a interlocking pin 46, into and through the corner segment inside surface pin entry aperture 37, into the connecting segment pin entry aperture 31; inserting a second connecting segment 8, end side surface 29, into the corner segment 4, opposing end side surface 40, side cavity 22, inserting a interlocking pin 46, into and through the corner segment inside surface pin entry aperture 37, into the connecting segment pin entry aperture 31; inserting the opposing side of the second connecting segment 8, end side surface 29, into side bar 72, end side surface 21, side cavity 22, inserting a interlocking pin 46, into and through the side bar inside surface pin entry aperture 19, into the connecting segment pin entry aperture 31; inserting a third connecting segment 8, end side surface 29, into the side segment 72, opposing end side surface 21, side cavity 22, inserting a interlocking pin 46, into and through the side segment inside surface pin entry aperture 19, into the connecting segment pin entry aperture 31; inserting the opposing side of the third connecting segment 8, end side surface 29, into the corner segment 5, end side surface 40, side cavity 22, inserting a interlocking pin 46 into and through the corner segment inside surface pin entry aperture 37, into the connecting segment pin entry aperture 31; inserting a fourth connecting segment 8, end side surface 29, into the corner segment 5, opposing end side surface 40, side cavity 22, inserting a interlocking pin 46, into and through the corner segment inside surface pin entry aperture 37, into the connecting segment pin entry aperture 31; inserting the opposing side of the fourth connecting segment 8, end side surface 29, into side bar 3, end side surface 21, side cavity 22, inserting a interlocking pin 46, into and through the side bar inside surface pin entry aperture 19, into the connecting segment pin entry aperture 31; inserting a fifth connecting segment 8, end side surface 29, into side bar 3, opposing end side surface 21, side cavity 22, inserting a interlocking pin 46, into and through the side bar inside surface pin entry aperture 19, into the connecting segment pin entry aperture 31; inserting the opposing side of the fifth connecting segment 8, end side surface 29, into corner segment 6, end side surface 40, side cavity 22, inserting a interlocking pin 46, into and through the corner segment inside surface pin entry aperture 37, into the connecting segment pin entry aperture 31; inserting a sixth connecting segment 8, end side surface 29, into the corner segment 6, opposing end side surface 40, side cavity 22, inserting a interlocking pin 46, into and through the corner segment inside surface pin entry aperture 37, into the connecting segment pin entry aperture 31; inserting the opposing side of the sixth connecting segment 8, end side surface 29, into the side bar 73, end side surface 21, side cavity 22, inserting a interlocking pin 46, into and through the side bar inside surface pin entry aperture 19, into the connecting segment pin entry aperture 31; inserting a seventh connecting segment 8, end side surface 29, into the side segment 73, opposing end side surface 21, side cavity 22, inserting a interlocking pin 46, into and through the side segment inside surface pin entry aperture 19, into the connecting segment pin entry aperture 31; inserting the opposing side of the seventh connecting segment 8, end side surface 29, into the corner segment 7, end side surface 40, side cavity 22, inserting a interlocking pin 46, into and through the corner segment inside surface pin entry aperture 37, into the connecting segment pin entry aperture 31; inserting a eighth connecting segment 8, end side surface 29, into the corner segment 7, opposing end side surface 40, side cavity 22, inserting a interlocking pin 46, into and through the corner segment inside surface pin entry aperture 37, into the connecting segment pin entry aperture 31; and inserting the opposing side of the eighth connecting segment 8, end side surface 29, into side bar 2, end side surface 21, side cavity 22, inserting a interlocking pin 46, into and through the side bar inside surface pin entry aperture 19, into the connecting segment pin entry aperture 31.

The stretcher bar frame depicted in FIG. 1, consists of the four side bars segments 2, 3, 72, and 73, the four corner segments 4, 5, 6, and 7, the eight internal connecting segments 8, sixteen interlocking pins 46, two cross brace center segments 35 and 53, four cross brace extension segments 58, and five barrel nuts and bolts 69.

Figure 2:
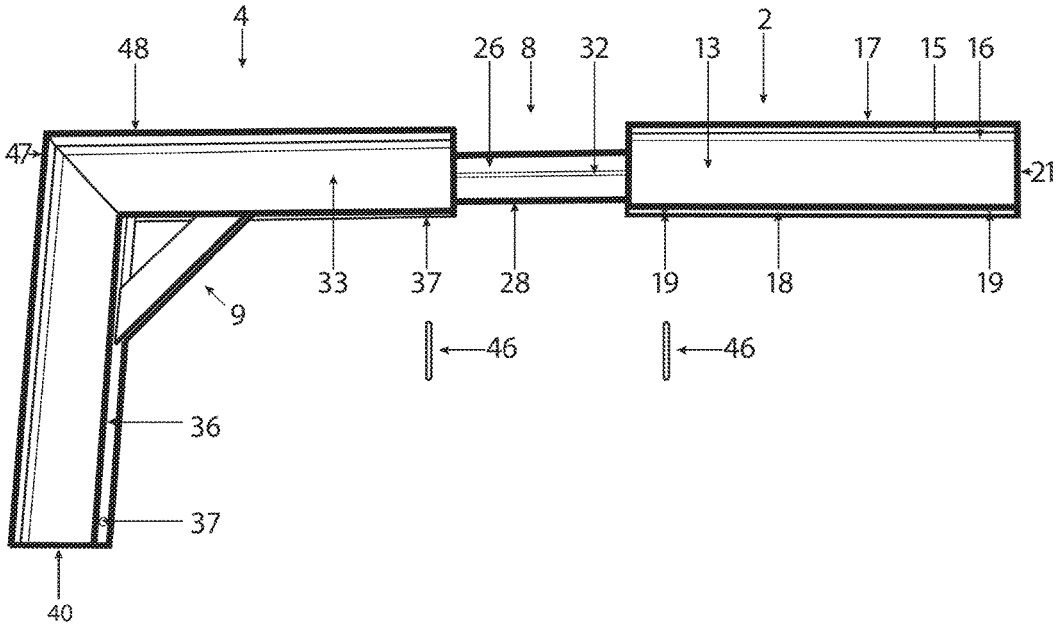
FIG. 2 is a three-dimensional perspective front view; illustrating the means to connect a stretcher bar frame, side bar segment, corner segment, and internal connecting segment in FIG. 1; and illustrating the side bar and corner segments inside surface pin entry apertures and pins.

FIG. 2, is a three-dimensional perspective view depicting how a corner segment 4, viewed from the front side surface 33, a partially inserted internal connecting segment 8, viewed from the top side surface 26, and side bar 2, viewed from the front side surface 13, and interlocking pins 46, illustrating the slide fit structural connection and alignment means to connect together an adjacent side bar segment 2, corner segment 4, and a connecting segments 8 in FIG. 1, assembled of one of various arrays of configurable stretcher bar frame 1. This same sliding together and interlocking pin locking mechanism 46, of stretcher bar frame segments continues and is utilized to connect additional side bars 2, corners 4, and connecting 8 segments, until the desire stretcher bar frame 1 size is constructed. Each side bar 2 or corner 4 segment can be slid and interlocked together to another side bar 2 or corner segment 4, by inserting a internal connecting segment 8, end side surface 29, inward into a side bar 2, end side surface 21, side cavity 22, or, by inserting a connecting segment 8, end side surface 29, inward into a corner segment 4, end side surface 40, side cavity 22.

The outside length of each corner segment 4, depicted in FIG. 1, is 12 inches on each outside surface 35. The outside length of the side bar 2, segments depicted in FIG. 1 is 12 inches in length. The most common length of a side bar 2, segment is 12 inches. Side bars 2, are always added or removed in pairs when assembling a stretcher bar frame 1.

Side bar segment and corner segments can be combined to assemble side lengths and widths ranging from 24 inches to 96 inches, and various common size stretcher bar side lengths in between. For illustrative purposes only, the number and lengths of the side bar 2 and corner 4 segments required to assemble a range of stretcher bar frame 1, side lengths from 24 inches to 96 inches is listed in the below.

Bars Required for Specific Side Lengths

| | |
|---|---|
| 2-12" corners | 24" |
| 2-12" corners plus 1-12" side bar | 36" |
| 2-12" corners plus 2-12" side bars | 48" |
| 2-12" corners plus 3-12" side bars | 60" |
| 2-12" corners plus 4-12" side bars | 72" |
| 2-12" corners plus 5-12" side bars | 84" |
| 2-12" corners plus 6-12" side bars | 96" |

The overall dimensional length and width of the stretcher bar frame 1 is not limited to 96 inches or the above combination of side corner and side bars. Larger stretcher bar frames can be assembled by adding additional 12 inch, 24 inch, 36 inch, 48 inch, or longer side bar segments. Furthermore, with the addition and combination of 1, 2, 4 and 6 inch side bar segment, all one inch incremental lengths and width between 24 inches to 96 inches can be assembled. The length of side bar 2, 3, 72, and 73, and corner 4, 5, 6, and 7, segments are not limited to inches and can be in other measurement units (e.g., metric).

Figure 3:
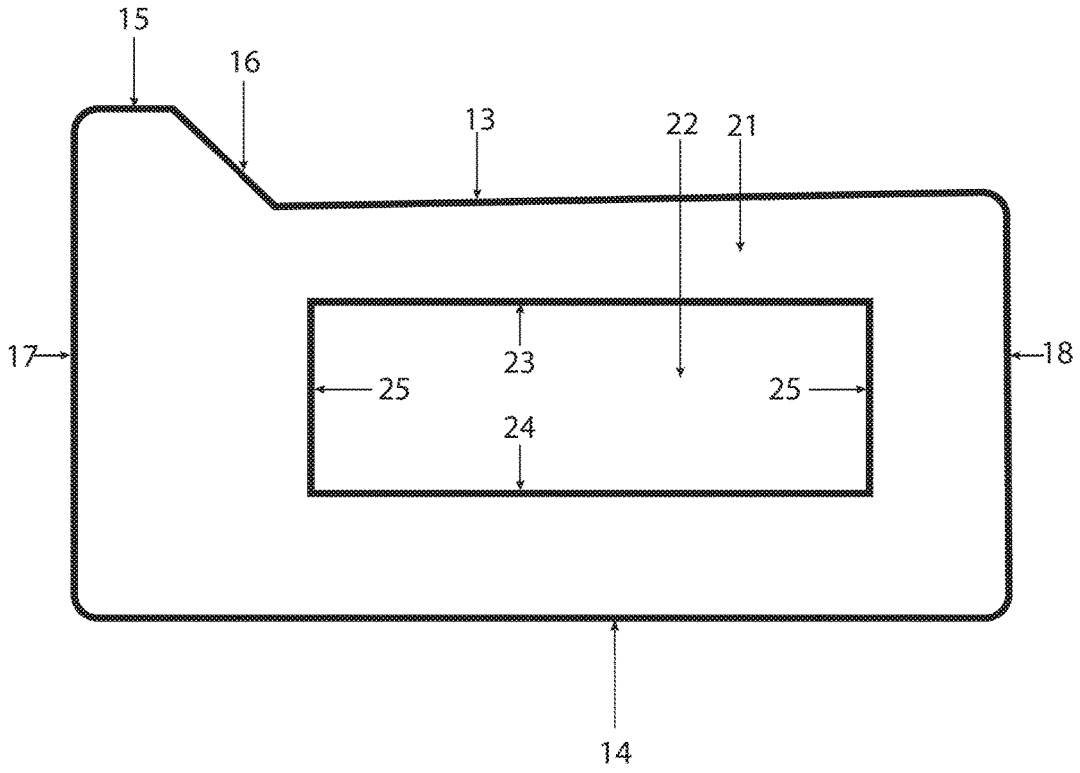
FIG. 3 is a two-dimensional end side surface view of a side bar segment in FIG. 2, illustrating female socket member side cavity of FIG. 1.
Figure 4:
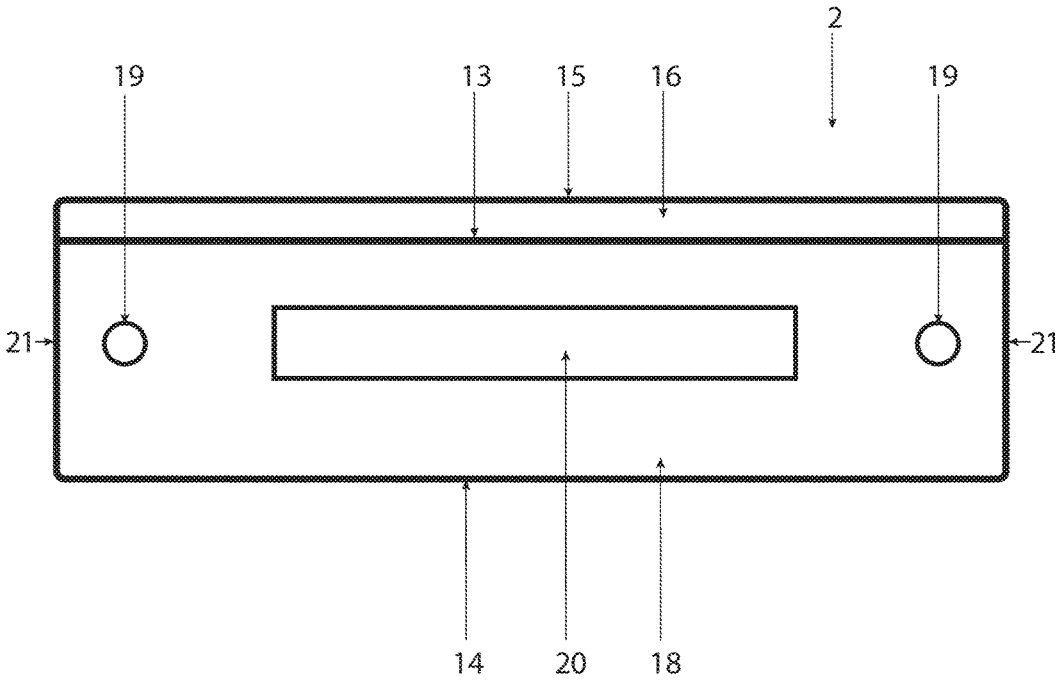
FIG. 4 is similar to that of FIG. 3, except the side bar segment has been rotated about its width-wise axis 90 degrees to illustrate the two inside surface, pin entry apertures, and adjustable cross-brace entry channel.
Figure 5:
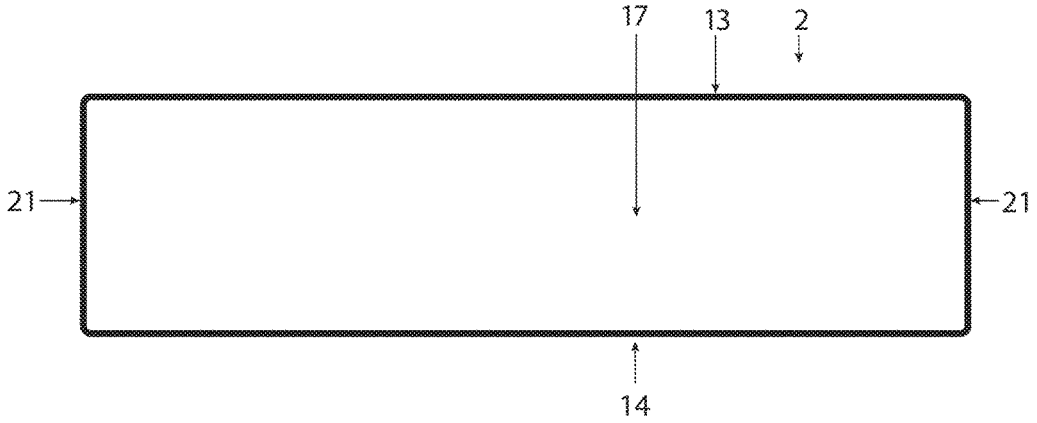
FIG. 5 is similar to that of FIG. 3, except the side bar segment has been rotated about its width-wise axis 90 degrees to illustrate the outside surface.
Figure 6:
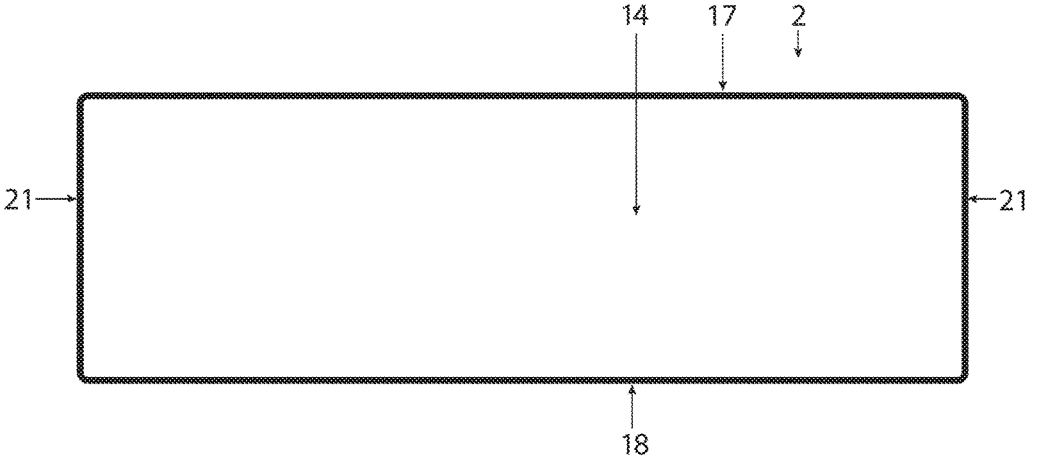
FIG. 6 is similar to that of FIG. 3, except the side bar frame section has been rotated about its height-wise axis 90 degrees to illustrate the back surface of the canvas fastening surface.

FIGS. 3, 4, 5, and 6, are detail drawing of the side bar segment-from different views. In FIG. 3, the side bar segment 2 has a front surface 13, a back surface 14, an outside surface 17, an inside surface 18, and two end side surfaces 21. The side bar segment also has an angular front side surface 16 between the flat front surface 13 and the extended curved front side canvas surface 15. Each side bar 2, end side surface 21, has a rectangular side cavity 22. The side cavity 22 encompasses the area between an internal top cavity surface 23, the opposing bottom cavity surface 24, and the pair of opposing side cavity surfaces 25, each of which connects the top surface to the bottom surface at the opposing side surface edges. In FIG. 4, the side bar segment 2 has an inside surface 18, has two inside surface pin entry aperture 19, proximately near each end side surface 21, along the center longitudinal axis end, and one inside surface cross brace entry channel 20, depending on the length of the side bar segment 2, which may be utilized if bowing is observed on excessively large stretcher bar frames 1. In FIG. 5, the side bar segment 2 has an outside surface 17, a front surface edge 13, a back surface edge 14, and two opposing end side surface edges 21. In FIG. 6, the side bar segment 2 has an back surface 14, an outside surface edge 17, a inside surface edge 18, and two opposing end side surface edges 21, within the stretcher bar frame 1.

Figure 7:
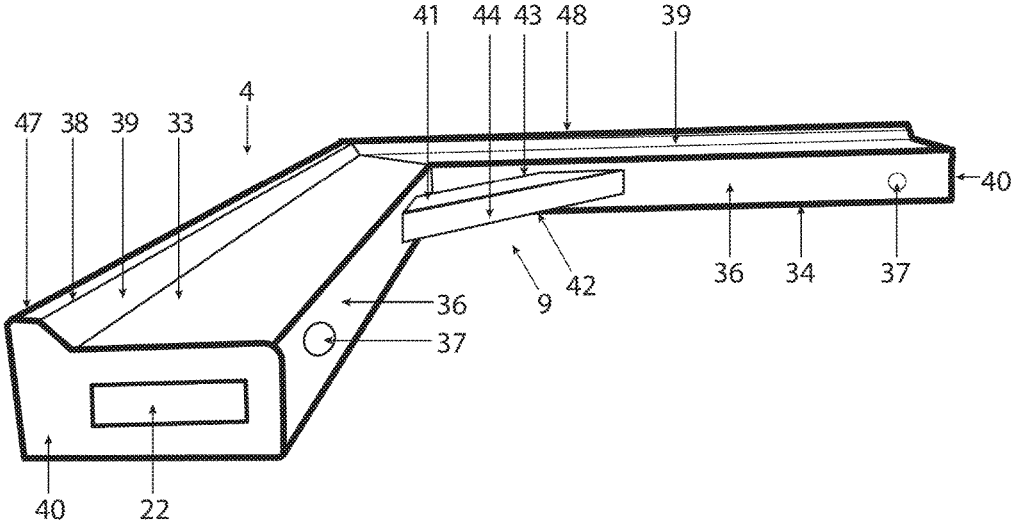
FIG. 7 is a three-dimensional longitudinal section view of a corner segment in FIG. 2, illustrating the front side surface, illustrating the end side surfaces, illustrating the female socket member side cavity, illustrating two inside surface, pin entry apertures, and illustrating the fixed corner angular cross brace.
Figure 8:
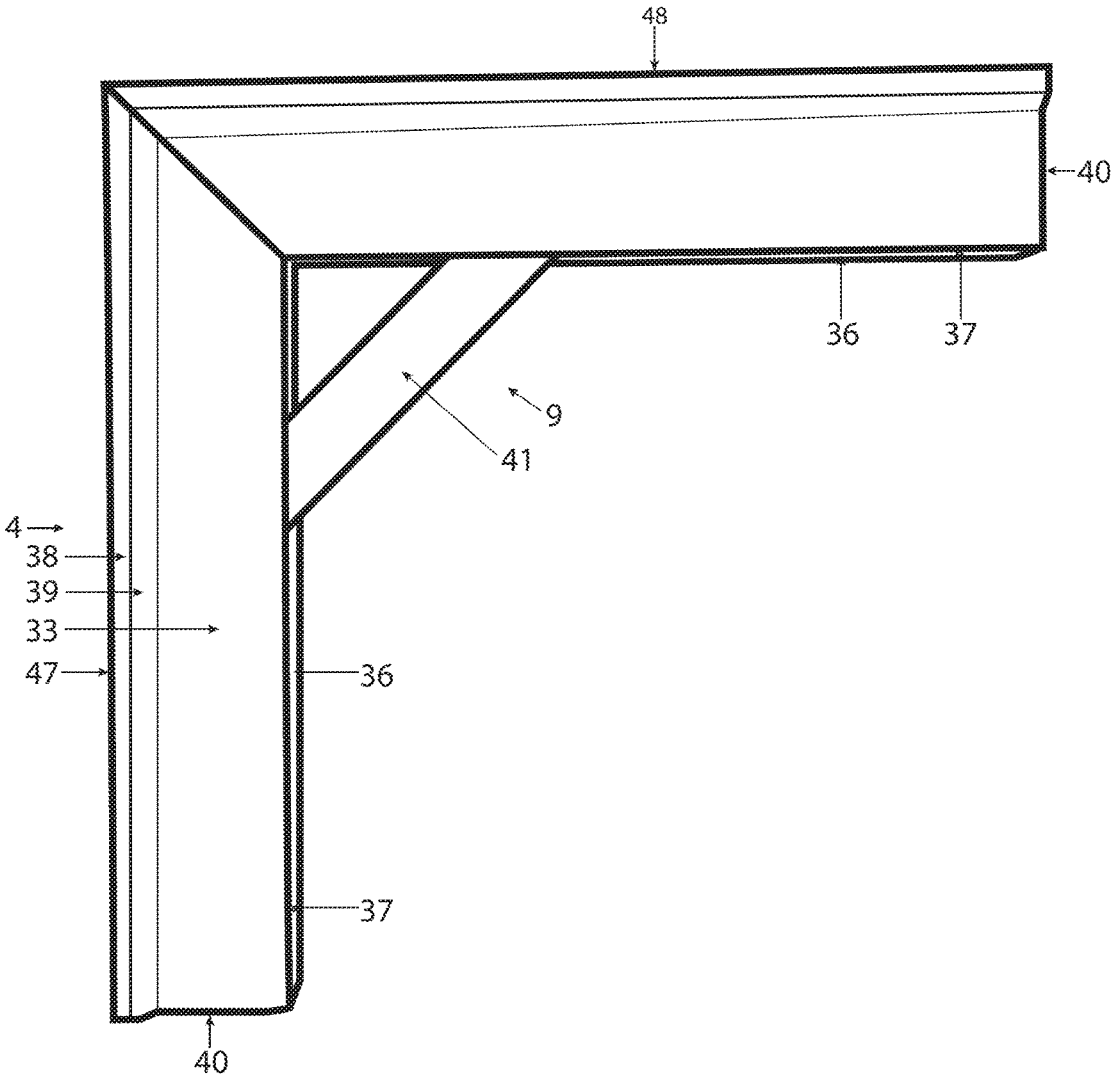
FIG. 8 is similar to that of FIG. 7, except the corner bar segment has been rotated about its height-wise axis 90 degrees to illustrate the front surface view of the extended curved canvas surface, angular surface, and flat front surface.
Figure 9:
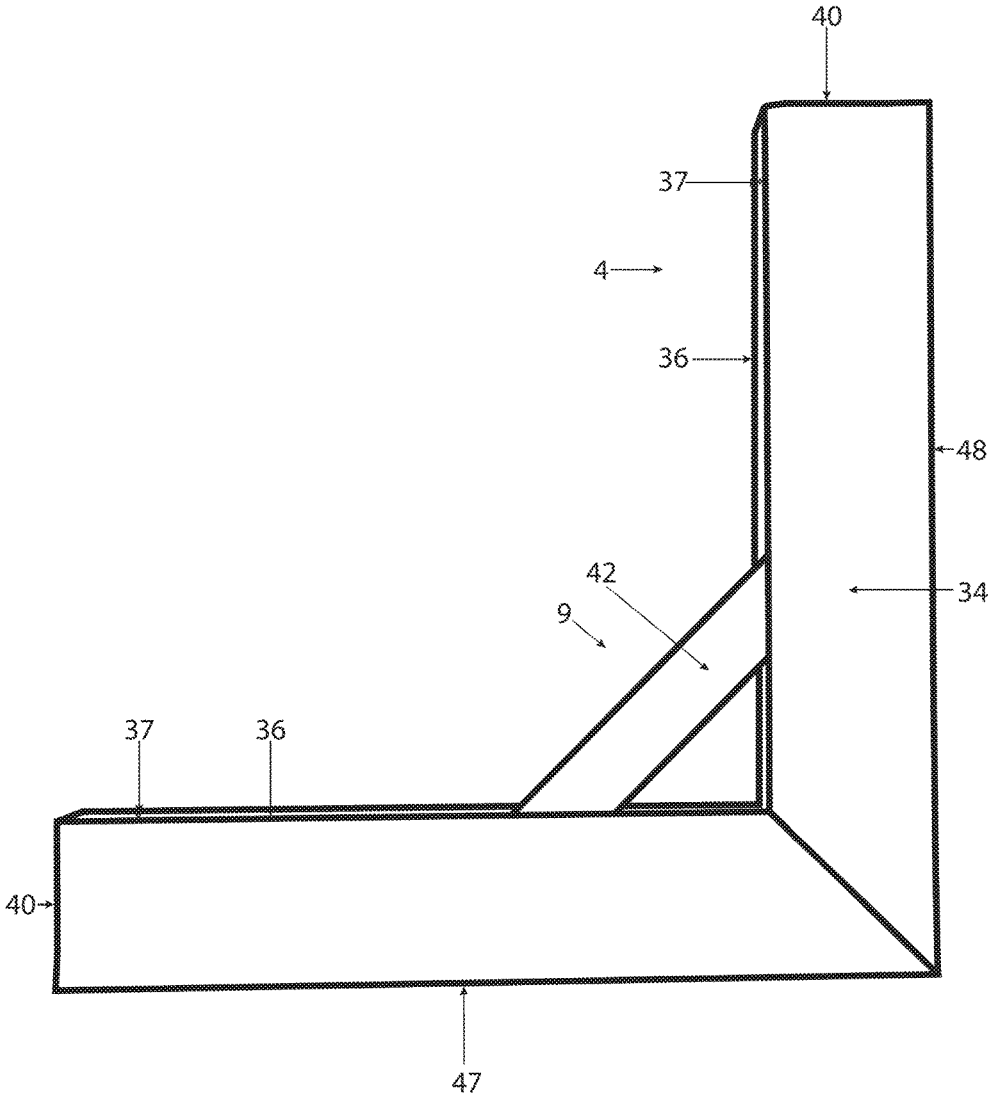
FIG. 9 is similar to that of FIG. 7, except the corner frame segment has been rotated about its height-wise axis 90 degrees to illustrate the back surface view of the of the canvas fastening surface.
Figure 10:
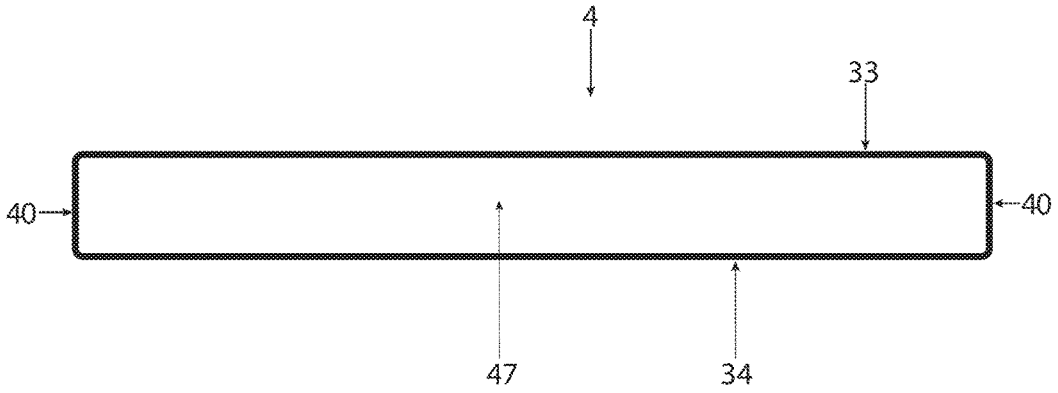
FIG. 10 is similar to that of FIG. 7, except the corner frame segment has been rotated about its width-wise axis 90 degrees to illustrate the left outside surface.
Figure 11:
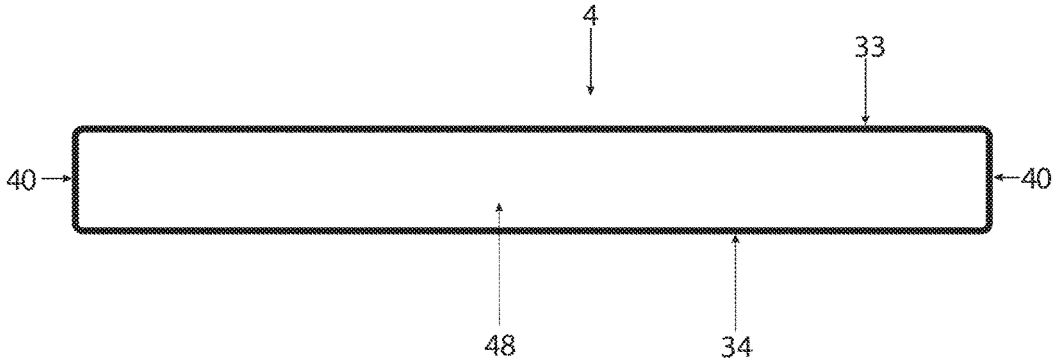
FIG. 11 is similar to that of FIG. 7, except the corner frame segment has been rotated about its width-wise axis 180 degrees to illustrate the right outside surface.

FIGS. 7, 8, 9, 10, and 11, are detail drawing of the fixed corner segment 4, from different views. FIG. 7, is a three-dimensional perspective view depicting corner segment 4, the front surface 33, a back surface 34, a left outside surface edge 47, a right outside surface edge 48, an inside surface 36, two end side surfaces 40, an angular front side surface 39, between the front side surface 33, and the extended curved front side canvas surface 38, an angular cross brace 9, having a front side surface 41, back surface 42, outside surface 43, and an inside surface 44. The inside surface 36, has a surface pin entry aperture 37, near each end side surface 40, along the center longitudinal axis end. FIG. 8, is a three-dimensional perspective view depicting the front side of corner segment 4, front surface 33, a left outside surface 47, a right outside surface 48, an inside surface 36, two end side surfaces 40, an angular front side surface 39, between the front surface 33, and the extended curved front side canvas surface 38, an angular cross brace 9, front side surface 41. The inside surface 36, depicts a surface pin entry aperture 37, proximately near each end side surface 40, along the center longitudinal axis end. FIG. 9, is a three-dimensional perspective view depicting the back side of the corner segment 4, back surface 34, a left outside surface edge 47, a right outside side surface edge 48, an inside surface 36, two end side surfaces 40, an angular cross brace 9, back surface 42. The inside surface 36, depicts a surface pin entry aperture 37, along the center longitudinal axis proximately near each end side surface 40. FIG. 10, is a two-dimensional perspective view depicting the corner segment 4, left outside surface 47, a front side surface edge 33, a back surface edge 34, and two opposing end side surface edges 40. FIG. 11, is a two-dimensional perspective view depicting the corner segment 4, right outside surface 48, a front side surface edge 33, a back surface edge 34, and two opposing end side surface edges 40.

Figure 12:
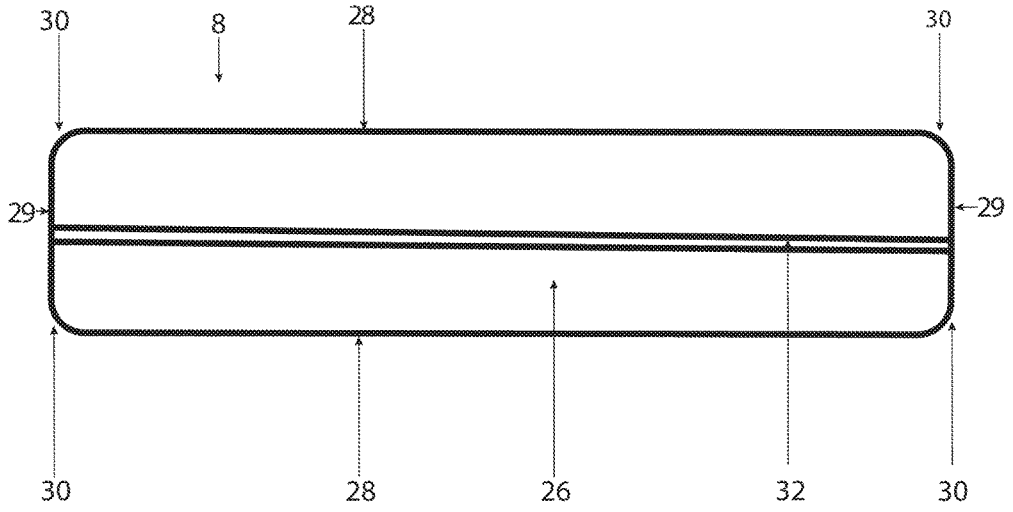
FIG. 12 is a two-dimensional longitudinal front side surface view of an internal connecting frame segment male plug member in FIG. 2, illustrating the connecting segment's upper pressure release channel, illustrating the connecting segment four curve corners.
Figure 13:
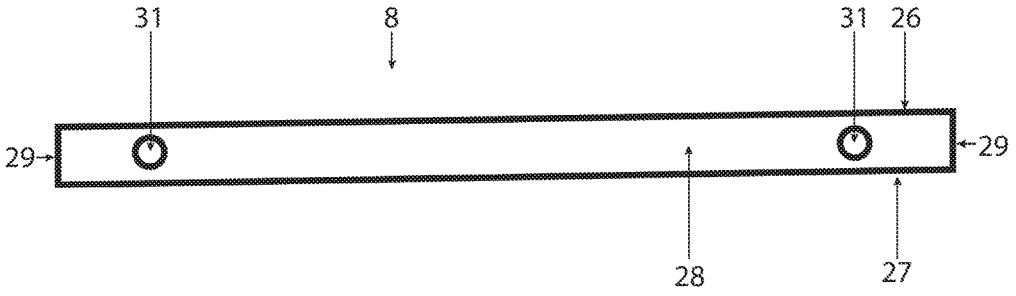
FIG. 13 is similar to that of FIG. 12, except the connecting frame segment has been rotated about its height-wise axis 90 degrees illustrating two inside surface, pin entry apertures.
Figure 14:
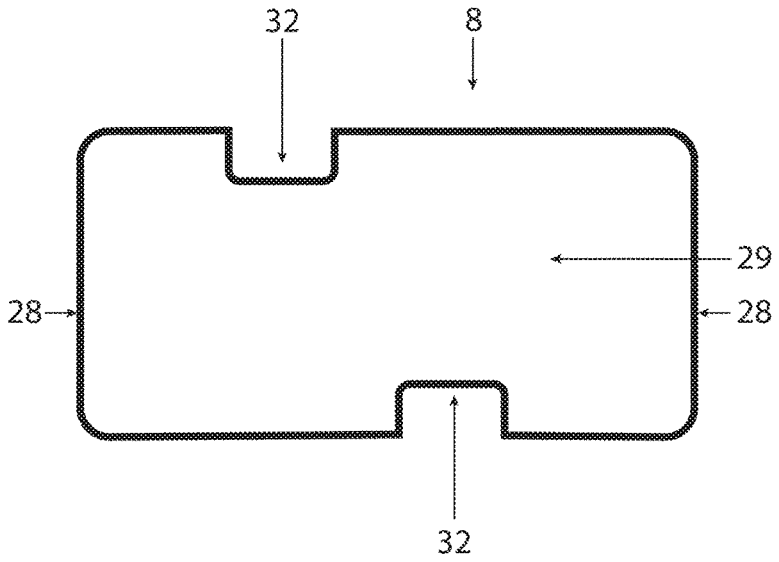
FIG. 14 is similar to that of FIG. 12, except the internal connecting frame segment has been rotated about its length-wise axis 90 degrees illustrating the end side surface view, illustrating the upper and lower pressure release channels, and illustrating four curve corners.
Figure 15:
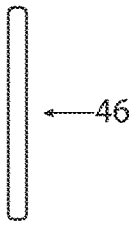
FIG. 15 is a two-dimensional length wide view of an interlocking pin.

FIGS. 12, 13, and 14, are detail drawing of the internal connecting segment from different views. FIG. 12, is a two-dimensional perspective view depicting the connecting segment 8, front side surface 26, two opposing side surface edges 28, two opposing end side surface edges 29, four curved side surfaces 30, and a connecting segment pressure release channel 32. FIG. 13, is a two-dimensional perspective view depicting the internal connecting segment 8, side surface edge 28, front side surface edge 26, back surface edge 27, two opposing end side surface edges 29, and two interlocking pin entry apertures 31, along the center longitudinal axis proximately near each end side surface edges 29. FIG. 14, is a two-dimensional perspective view depicting a connecting segment 8, end side surface 29, and identical front and back side pressure release channels 32. FIG. 15, is a two-dimensional perspective view depicting a interlocking pin 46, utilized to secure side bar segments 2, 3, along the periphery within the four corner segments 4, 5, 6, and 7, of the stretcher bar frame 1, in FIG. 1.

FIG. 2, illustrates the structural means to guide and align connecting segment 8 into side bar 2 and corner segment 4. As depicted in FIG. 2, the internal connecting segment's width ends 29, are inserted into the side bar 2, side cavity 22 and the corner segment 4, side cavity 40. A connecting segment 8 can be inserted into either a side bar end side surface 21 or a corner end side surface 29, in assembling various size stretcher bar frames.

The stretcher bar frame 1, features a quick inside surface release, interlocking, mechanism to connect and interlock or disconnect side bar segments 2, 3, 72, and 73, corner segment 4, 5, 6, and 7, and connecting segments 8.

To interlock a side bar segment 2, an interlocking pin 46, is inserted inward and through a side bar inside surface pin entry aperture 19, and continuing into the internal connecting segment pin entry aperture 31. To interlock a connecting segment 8, an interlocking pin 46, is inserted inward and through a connecting segment inside surface pin entry aperture 37, and into the connecting segment pin entry aperture 31. To release a side bar segment 2, from a connecting segment 8, the interlocking pin 46, is pulled in an outward direction from the connecting segment pin entry aperture 31, and from the side bar inside surface pin entry aperture 19. To release a corner segment 4, from a connecting segment 8, the interlocking pin 46, is pulled outward direction from the connecting segment pin entry aperture 31, and from the corner segment inside surface pin entry aperture 37. This same connection mechanism applies through the construction of the stretcher bar frame 1, allowing for assembling or disassembling of adjoining stretcher bar frame 1 side bar, corner 4, and connecting 8 segments.

In FIG. 3, of this embodiment, is a cross-sectional end side surface 21 view of each side bar 2, depicting an extended curved front canvas surface 15, an angular front-side surface 16, and a front side surface 13. The extended curved front canvas surface 15, is integrated into each stretcher bar frame 1, side bar 2, and corner segment 4, to provide a supporting rim edge around the stretcher bar frame 1 perimeter, to support canvases or other material above the majority of the front side surface 13. The adjacent extended curved front canvas surface 15, has an angular front-side surface 16, sloping downward from the extended curved front canvas surface 15, to the larger front surface 13, and is designed to allow the main body of the stretcher bar frame surface to remain flat and without indentation after a canvas has been fastened. The extended curved front canvas surface 15, also serves to reduce adherence of paint or oil leaching through a canvas on to the stretcher bar frame 1, thus allowing a canvas to be easily removed.

FIGS. 6 and 9, depicts the side bar 2, flat back surface 14, and corner segment 4, flat back surface 34, to secure a canvas or other material using pins, nails, or other types of fasteners. The process of fastening a canvas to all associated side bars 2 and corner segments 4, continues until the front side surface of a canvas or other material is taut, flat, and secured to the back surfaces of the stretcher bar frame 1.

The stretcher bar frame 1 can be quickly lengthen, shorten, reconfigured, dismantled, transported or stored. To lengthen or reconfigure, a male plug member 11, is inserted inward into the female socket member 12, side cavity 22, and secured with a interlocking pin 46. To dismantled, the male plug member 11, is pulled outward from the female socket member 12, side cavity 22, allowing the connecting side bar 2, corner 4 and connecting 8 segments to be released and separated from other adjoining stretcher bar frame 1 segments. This process is continued until the stretcher bar frame 1, is completely dismantled or until assembled to another square or rectangular shape stretcher bar frame 1.

FIG. 4, depicts the inside surface cross-brace entry channel 20, that are incorporated into and along each side bar inside surface 18, of each side bar 2. The cross-brace entry channel 20, are used for added tension and stability, if a cross-brace is necessary for bowing.

Figure 16:
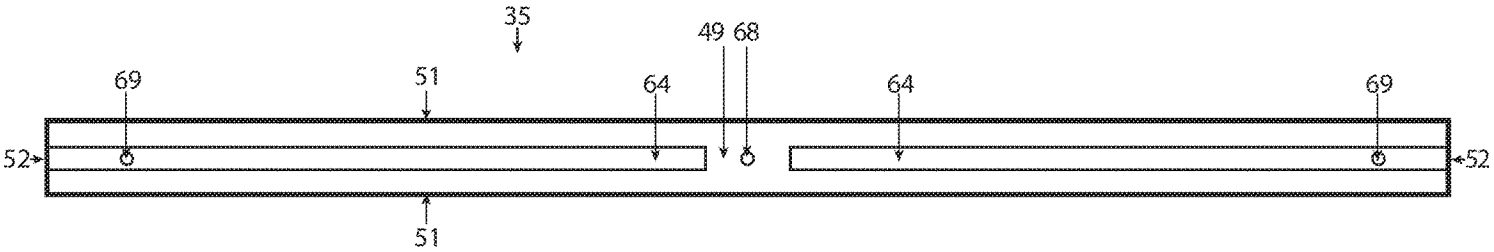
FIG. 16 is a two-dimensional length wide view of the front side surface of cross brace center segment one in FIG. 1.
Figure 17:
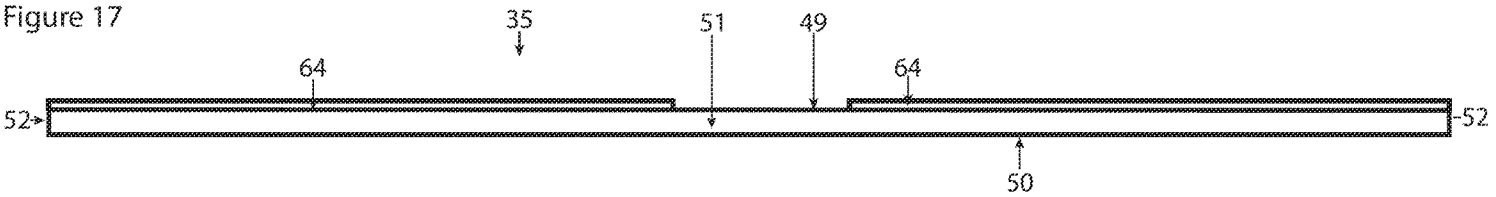
FIG. 17 is similar to that of FIG. 16, except the cross brace center segment one has been rotated about its width-wise axis 90 degrees to illustrate the side surface.
Figure 18:
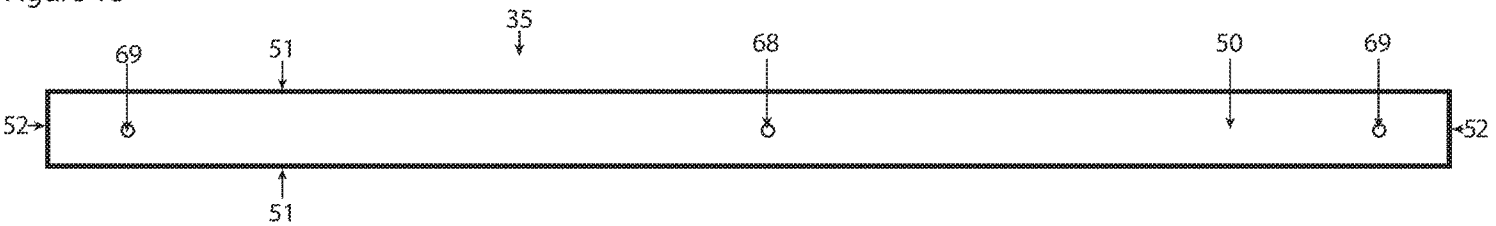
FIG. 18 is similar to that of FIG. 16, except the cross brace center segment one has been rotated about its width-wise axis 180 degrees to illustrate the back side surface.
Figure 19:
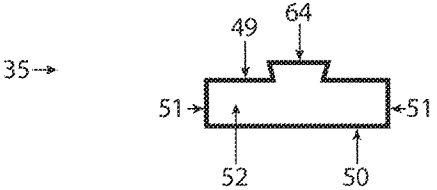
FIG. 19 is similar to that of FIG. 16, except the cross brace center segment one has been rotated about its height-wise axis 90 degrees to illustrate the outside end surface.

FIGS. 16, 17, 18, and 19 are detail drawing of the cross brace center segment one from different views. FIG. 16, is a two-dimensional perspective view depicting the cross brace center segment one 35, front side surface 49, two opposing side surface edges 51, two opposing end side surface edges 52, two dovetail 64, cross brace center segment one nut and bolt aperture 68, and cross brace adjustable one nut and bolt apertures 69. FIG. 17, is a two-dimensional perspective view depicting the cross brace center segment one 35, back side surface 50, two opposing side surface edges 51, two opposing end side surface edges 52, and cross brace center segment one nut and bolt aperture 68, and cross brace adjustable one nut and bolt apertures 69. FIG. 18, is a two-dimensional perspective view depicting the cross brace center segment one 35, side surface edge 51, front side surface edge 49, back surface edge 50, two opposing end side surface edges 52, and two dovetail surfaces 64, along the center longitudinal axis. FIG. 19, is a two-dimensional perspective view depicting the cross brace center segment one 35, end side surface 52, front side surface edge 49, back surface edge 50, two opposing side surface edges 51, and dovetail 64, of the stretcher bar frame 1, in FIG. 1.

Figures 20, 21, 22, 23:
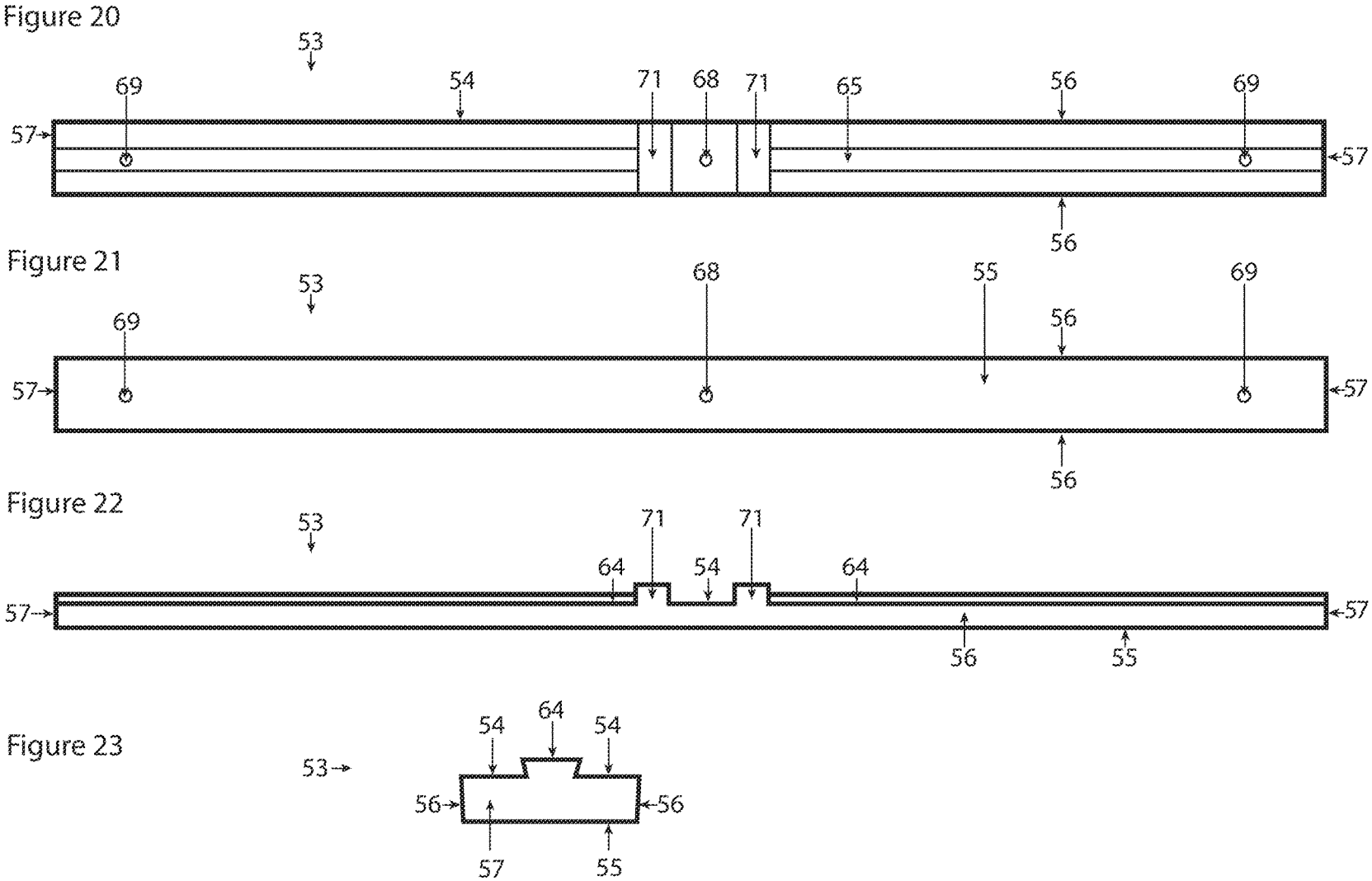
FIG. 20 is a two-dimensional length wide view of the front side surface of cross brace center segment two in FIG. 1.
FIG. 21 is similar to that of FIG. 20, except the cross brace center segment two has been rotated about its width-wise axis 180 degrees to illustrate the back side surface.
FIG. 22 is similar to that of FIG. 20, except the cross brace center segment two has been rotated about its width-wise axis 90 degrees to illustrate the side surface.
FIG. 23 is similar to that of FIG. 20, except the cross brace center segment two has been rotated about its height-wise axis 90 degrees to illustrate the outside end surface.

FIGS. 20, 21, 22, and 23 are detail drawing of the cross brace center segment two from different views. FIG. 20, is a two-dimensional perspective view depicting the cross brace center segment two 53, front side surface 54, two opposing side surface edges 56, two opposing end side surface edges 57, two stationary center blocks 71, two dovetail 64, cross brace center segment member nut and bolt aperture 68, and cross brace adjustable two nut and bolt apertures 69. FIG. 21, is a two-dimensional perspective view depicting the cross brace center segment two 53, back side surface 55, two opposing side surface edges 56, two opposing end side surface edges 57, cross brace center segment nut and bolt aperture 68, and cross brace adjustable two nut and bolt apertures 69. FIG. 22, is a two-dimensional perspective view depicting the cross brace center segment two 53, side surface 56, front side surface edge 54, back surface edge 55, and two stationary center blocks 71. FIG. 23, is a two-dimensional perspective view depicting the cross brace center segment two 53, end side surface 57, front side surface edge 54, back surface edge 55, two opposing side surface edges 56, and dovetail 64, of the stretcher bar frame 1, in FIG. 1.

Figure 27:
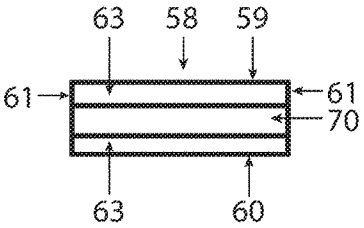
FIG. 27 is similar to that of FIG. 24, except the cross brace extension segment has been rotated counter-clock wise about its height-wise axis 90 degrees to illustrate the outside end surface.
Figure 28:
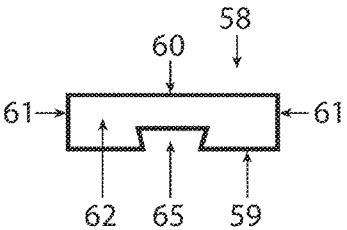
FIG. 28 is similar to that of FIG. 24, except the cross brace extension segment has been rotated clock-wise about its height-wise axis 90 degrees to illustrate the interior end surface.
Figure 24:
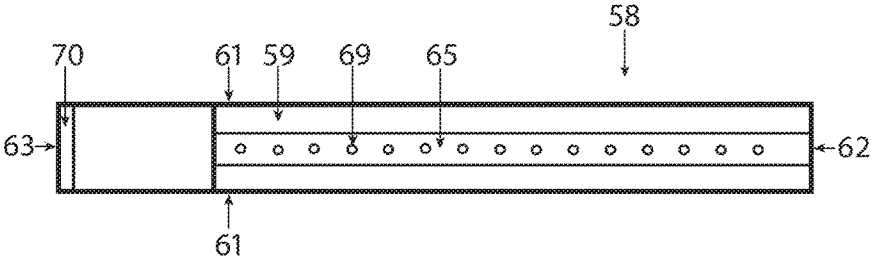
FIG. 24 is a two-dimensional length wide view of the front side surface of cross brace extension segment in FIG. 1.
Figure 25:
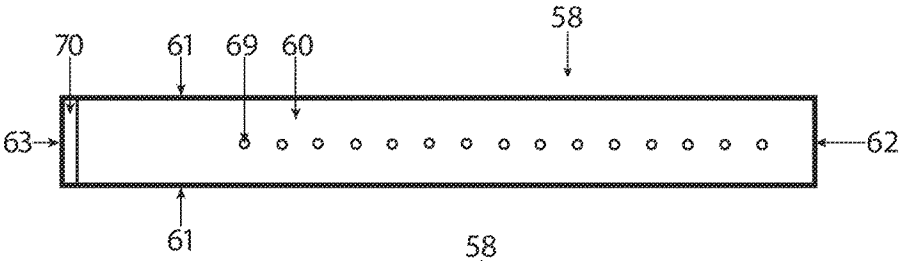
FIG. 25 is similar to that of FIG. 24, except the cross brace extension segment has been rotated about its width-wise axis 180 degrees to illustrate the back side surface.
Figure 26:
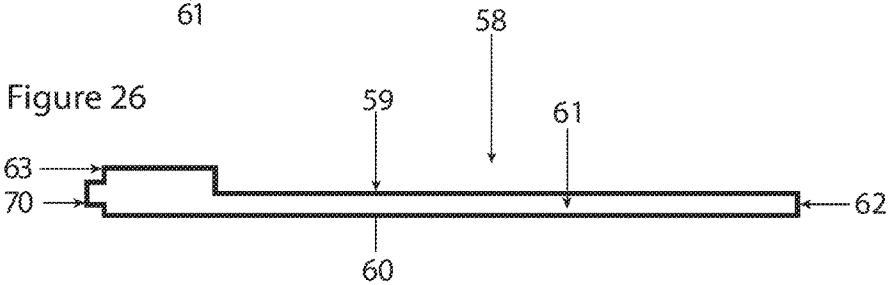
FIG. 26 is similar to that of FIG. 24, except the cross brace extension segment has been rotated about its width-wise axis 90 degrees to illustrate the side surface.

FIGS. 24, 25, 26, 27, and 28 are detail drawing of the cross brace extension segment from different views. FIG. 24, is a two-dimensional perspective view depicting the cross brace extension segments 58, front side surface 59, two opposing side surface edges 61, outside end surface edges 63, interior end side surface edge 62, cross brace insert 70, dovetail socket 65, cross brace adjustable one nut and bolt apertures 69. FIG. 25, is a two-dimensional perspective view depicting the cross brace extension segment 58, back side surface 60, two opposing side surface edges 61, outside end surface edges 63, interior end side surface edge 62, and cross brace insert 70, and cross brace adjustable one nut and bolt apertures 69. FIG. 26, is a two-dimensional perspective view depicting the cross brace extension segment 58, side surface 61, front side surface edge 59, back surface edge 60 outside end surface edges 63, interior end side surface edge 62, and cross brace insert 70. FIG. 27, is a two-dimensional perspective view depicting the cross brace extension segment 58, outside end surface 63, front side surface edge 59, back surface edge 60, two opposing side surface edges 61, and cross brace insert 70. FIG. 28 is a two-dimensional perspective view depicting the cross brace extension segment 58, interior end surface 62, front side surface edge 59, back surface edge 60, two opposing side surface edges 61, and dovetail socket 65.

Figure 29:
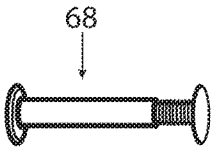
FIG. 29 is a two-dimensional length wide view of a barrel nut and bolt.

FIG. 29, is a two-dimensional perspective view depicting a interlocking barrel nut and bolt 67, utilized to secure cross brace center segment one 35, with cross brace extension segments 58, and utilized to secure cross brace center segment two 53, with cross brace extension segments 58 along the periphery within the four corner segments 4, 5, 6, and 7, of the stretcher bar frame 1, in FIG. 1.

The overall dimensional length and width of each cross brace center segment 35, and 53, and cross brace extension segments 58, in stretcher bar frame FIG. 1 is not limited to the six adjustable cross brace segments or the above combination of side corner and side bars. Larger stretcher bar frames can be assembled by larger cross braces segments or multiple positional cross brace segments.

The length of cross brace center segment 35 and 53, and cross brace extension segments 58, are not limited to inches and can be in other measurement units (e.g., metric). The position of cross brace adjustable nut and bolt apertures is can vary depending on the length or the cross brace extension segments 58.

The adjustable cross brace segments in FIG. 1, can be quickly lengthen, shorten, assembled, dismantled, transported or stored, by removing a barrel nut and bolt 67, from a cross brace adjustable one nut and bolt apertures 69, and sliding a cross brace extension segment 58, socket 65, inward or outward along the matching cross brace center segment 35 or 53, dovetails 64, and dovetail. This process is continued until the stretcher bar frame 1, is completely dismantled or until assembled to another square or rectangular shape stretcher bar frame 1.

The outside end surface 63, of each adjustable cross brace 47, has a cross brace insert 70, matching and fitting within side bar segment 2, inside surface cross brace entry channel 20, which may be utilized if bowing is observed on excessively large stretcher bar frames 1.

The stretcher bar frame system can be accommodated for various traditional and gallery dimensional and profile depths.

The specifications and drawings of this invention may be embodied and practiced in other specific forms and modification without departing from the spirit and essential characteristics thereof. The present embodiments therefore are considered in all respects as illustrative and not restrictive. The scope of the invention is indicated by the appended claims rather than by the foregoing description. All variations, substitutions, departures, and changes that come within the meaning and range of equivalency of the claims therefore are intended to be embraced therein.

What is claimed is:

1. An adjustable stretcher bar frame and cross brace devise for mounting, re-stretching, remounting, and removing a fine art canvas comprising:

a plurality of interchangeable, variable lengths, side bar segments and fixed L-shaped, right angle corner segments, each having a front side surface over which said canvas is to be stretched;

each said side bar segment, said corner segment, and internal connecting segment having a pair of interconnecting latching pin apertures;

each said side bar segment and said corner segment having an inside surface cross brace entry channel for mating with multiple cross brace extension segment inserts;

each said side bar segment having an open middle cavity female socket member at center width-wise axis thereof, having an internal connecting top surface, a bottom surface, and a pair of opposing side surfaces, extending from the first end side surface to the second end side surface;

each said corner segment having an open middle cavity female socket member at center width-wise axis thereof, having an internal connecting top surface, a bottom surface, and a pair of side surfaces, extending from the first end side surface to a perpendicular second end side surface;

a said internal connecting segment male plug member having an outside top surface, a bottom surface, a pair of opposing side surfaces, a pair of opposing end side surfaces, sized to insert within said open middle cavity of said side bar segment and said corner segment;

each said side bar segment and said corner segment having a said front side surface comprising of an angular flat surface between an extended rounded surface and flat surface;

each said side bar segment and said corner segment having an exposed fiat wooden back side surface for mounting canvas with staples, tacks, or fasteners; and a said cross brace comprising a first cross brace enter segment, a second cross brace center segment, and four adjustable cross brace extension segments, said first cross brace center segment and said second cross brace center segment each having a right side and left side dovetail along its front side surface, length-wise axis thereof, a center nut and bolt aperture, and two outer said nut and bolt apertures, and four adjustable said cross brace extension segments each having a single dovetail socket along its front side surface, length-wise axis thereof, and multiple, variable spaced, said, nut and bolt apertures.

2. The adjustable stretcher bar frame according to claim 1 being capable of aligning and interconnecting said latching pin entry apertures, on each said side bar segment, said corner segment, arid said internal connecting segment, with an adjacent said side bar segment or an adjacent said corner segment, and fastened with push-in latching pins.

3. The adjustable stretcher bar frame according to claim 1 wherein the length and width can be increased or decreased by adding or removing side bar segments to form an array of various size square or rectangular frames.

4. The adjustable stretcher bar frame said cross brace according to claim 1 being capable of perpendicularly mating at the center of said front side surface of said first cross brace center segment and at the center of said front side surface of said second cross brace center segment, at their respective said center nut and bolt aperture and fastened by said nut and bolt.

5. The adjustable stretcher bar frame said cross brace segments according to claim 1 wherein each said cross brace extension segment said dovetail socket being capable of mating with said dovetail with said first cross brace center segment and said second cross brace center segment.

6. The, adjustable stretcher bar frame said cross brace segments according to claim 1 being capable of adjusting the length of each individual said cross brace extension by sliding said cross brace extension said dovetail socket, inward or outward from the center of the said cross brace, along said cross brace center segment said dovetail.

7. The adjustable-stretcher bar frame segments according to claim 1 being capable of quick and easy assembling, dismantling, and reconfiguring of by a said internal connecting segment is inserted between said open middle cavities of two said side bar segments or between said open middle cavities of said side bar segment and said corner segment, said latching pin apertures are matched, and latched by pushing-in said latching pins or unlatched by pulling-out said latching pins.

8. The adjustable stretcher bar frame said cross brace segments according to claim 1 being capable of quick and easy assembling, dismantling, and reconfiguring when said nuts and bolts are inserted and fastened or unfastened and removed from said center nut and bolt aperture on said cross brace center segments, and between said cross brace center segments and said cross brace extensions.

* * * * *